US006393771B1

(12) United States Patent
Stetson

(10) Patent No.: US 6,393,771 B1
(45) Date of Patent: May 28, 2002

(54) COVER FOR CLOSING SURFACE DISPOSED UTILITY ACCESS OPENING

(76) Inventor: Michael Alan Stetson, 1 Via Respiro, Rancho Santa Margarita, CA (US)

( * ) Notice: Subject to any disclaimer, the term of this patent is extended or adjusted under 35 U.S.C. 154(b) by 0 days.

(21) Appl. No.: 09/502,030

(22) Filed: Feb. 10, 2000

(51) Int. Cl.[7] ..... E02D 29/14
(52) U.S. Cl. ..... 52/20; 52/742.14; 404/25
(58) Field of Search ..... 52/19, 20, 21, 52/742.13, 742.14; 404/25, 26

(56) References Cited

U.S. PATENT DOCUMENTS

| | | | | | |
|---|---|---|---|---|---|
| 4,015,373 | A | * | 4/1977 | Boissier | 52/20 |
| 4,456,397 | A | * | 6/1984 | Freis et al. | 404/25 |
| 4,499,695 | A | * | 2/1985 | Oger et al. | 52/19 |
| 4,919,564 | A | * | 4/1990 | Neathery et al. | 404/25 |
| 5,205,668 | A | * | 4/1993 | Adams | 404/26 |
| 5,209,601 | A | * | 5/1993 | Odill et al. | 404/26 |
| 5,240,346 | A | * | 8/1993 | Yin | 404/25 |
| 5,362,174 | A | * | 11/1994 | Yang | 404/25 |
| 5,549,411 | A | * | 8/1996 | Hawkins | 404/25 |
| 5,564,855 | A | * | 10/1996 | Anderson | 404/26 |
| 5,769,564 | A | * | 6/1998 | Hawkins | 404/25 |
| 5,827,007 | A | * | 10/1998 | Barton et al. | 404/25 |
| 5,899,024 | A | * | 5/1999 | Stannard | 52/20 |
| 5,951,200 | A | * | 9/1999 | Barton | 404/25 |
| 5,996,612 | A | * | 12/1999 | Vrawford | 137/371 |
| 5,997,212 | A | * | 12/1999 | Takada et al. | 404/25 |
| 6,035,581 | A | * | 3/2000 | McCoy | 52/20 |

* cited by examiner

*Primary Examiner*—Carl D. Friedman
*Assistant Examiner*—Yvonne M. Horton
(74) *Attorney, Agent, or Firm*—Stetina Brunda Garred & Brucker

(57) ABSTRACT

A cover for closing a utility access opening disposed in a fabricated surface having a defined external appearance. The cover includes a cap member engageable within the opening and having a substantially full cross sectional cavity for receiving a selected material. When the selected material is situated within the cavity, the cap member provides an exposed exterior having an appearance substantially identical with the defined external appearance of the fabricated surface. The cap member preferably includes a plurality of holes for draining moisture from its cavity site, a plurality of hand engageable grips for lifting the cover from the opening, and a plurality of support posts disposed within the cavity for weight stabilization. The present invention additionally includes methodology for constructing a fabricated surface having at least one opening therethrough that is closeable with a cover whose appearance replicates that of the surrounding surface. Such methodology includes providing a frame for defining an opening in the fabricated surface and providing a cap member engageable within the frame for covering the opening. The cap member has a substantially full cross-sectional cavity for placement of a selected material therein and is engaged within the frame for subsequent positioning within an intended plane of a fabricated surface. The fabricated surface is then constructed around the frame, and a selected material preferably being substantially identical in appearance to the fabricated surface is placed within the cavity of the cap member.

21 Claims, 3 Drawing Sheets

COVER FOR CLOSING SURFACE DISPOSED UTILITY ACCESS OPENING

CROSS-REFERENCE TO RELATED APPLICATIONS (Not Applicable)

STATEMENT RE: FEDERALLY SPONSORED RESEARCH/DEVELOPMENT (Not Applicable)

FIELD OF THE INVENTION

The present invention relates generally to covers for outdoor utility access openings, and more particularly to a cover having an exposed surface constructed from selected materials having a surface appearance substantially identical to the surface appearance of its surroundings.

BACKGROUND OF THE INVENTION

It is generally very desirable to have maintenance access for critical equipment such as plumbing fixtures and electrical devices which are placed underneath permanent or semi-permanent fabricated surfaces such as swimming pool patios, walkways, and driveways. These surfaces are typically constructed from concrete, asphalt, ceramic, or other durable materials which are often selected based on aesthetic as well as functional considerations. In these circumstances, access openings are particularly useful because removal of all or part of the surface can be very expensive and time consuming. Moreover, the surface may be disfigured or its structural integrity comprised if some or all of the surface must be repaired after the maintenance task is completed.

Although access devices are commonly provided for many fabricated surfaces, the cover or lids for current access devices typically are not constructed from the same materials as the surrounding fabricated surface. This shortcoming has several functional and cosmetic disadvantages. First, covers constructed from dissimilar materials can be a safety hazard because the cover will generally have a different coefficient of friction compared to the surrounding fabricated surface. For example, metal cover plates or grates having a relatively smooth finish are commonly used to cover access openings in concrete swimming pool patios having a slip-resistant finish. A significant change in surface texture such as this creates the risk for a slip and fall accident as unsuspecting persons step from one surface having a high coefficient of friction to another having a lower coefficient of friction or visa-versa. Moreover, the risk of an accident can be especially great when the cover plate is wet, as may be the case when children are playing near a swimming pool.

In addition to creating a potential safety hazard, access devices constructed from dissimilar materials can also be less desirable for cosmetic reasons. For instance, homeowners and business owners typically prefer a fabricated surface to have a uniform appearance, particularly when the surface is a prominent architectural feature and the surface is constructed from relatively ornate stone or concrete. In this setting, many persons would prefer a cover which matches the desirable visual appearance of the surrounding fabricated surface.

A third disadvantage with covers having dissimilar materials is the potential for differential expansion between the cover and the surrounding fabricated surface. Due to the difference in materials, the cover and fabricated surface will generally have different coefficients of expansion. As a result, the cover will expand and contract at a different rate compared to the surrounding surface as ambient temperature fluctuates. Depending on the size of the cover, the extent of ambient temperature fluctuations, and the relative difference in the respective coefficients of expansion, the differential expansion may distort or dislodge the cover if a clearance gap or buffer material is not provided between the cover and fabricated surface. Furthermore, even if sufficient clearance or buffer material is so provided, the resulting gap or buffer material may add to the unsightliness of the cover.

In view of the above considerations, a primary object of the present invention is to provide a cover for a utility access opening which is constructed from materials substantially identical in appearance to the surrounding surface.

Another object of the invention is to provide a mold which allows the cover to be constructed from cast materials and thereby match the visual and physical properties of structural surfaces formed from cast materials.

Yet another object of the present invention is to provide a custom fabricated cover and thereby allow greater flexibility in the choice of the materials for the cover and additionally reduce the quantity of access portholes that must be inventoried by vendors.

Still another object of the present invention is to provide a method for casting a cover for a utility access opening from materials having superior functional and aesthetic characteristics.

These and other objects of the present invention will become apparent throughout the description thereof which now follows.

SUMMARY OF THE INVENTION

The present invention is a cover for closing a utility access opening disposed in a fabricated surface having a defined external appearance. The cover includes a cap member engageable within the opening and having a substantially full cross sectional cavity for receiving a selected material. When the selected material is situated within the cavity, the cap member provides an exposed exterior having an appearance substantially identical with the defined external appearance of the fabricated surface. The cap member preferably includes a plurality of holes for draining moisture from its cavity site, a plurality of hand engageable grips for lifting the cover from the opening, and a plurality of support posts disposed within the cavity for weight stabilization.

The present invention additionally includes methodology for constructing a fabricated surface having at least one opening therethrough that is closeable with a cover whose appearance replicates that of the surrounding surface. Such methodology includes providing a frame for defining an opening in the fabricated surface and providing a cap member engageable within the frame for covering the opening. The cap member has a substantially full cross-sectional cavity for placement of a selected material therein and is engaged within the frame for subsequent positioning within an intended plane of a fabricated surface. The fabricated surface is then constructed around the frame, and a selected material preferably being substantially identical in appearance to the fabricated surface is placed within the cavity of the cap member.

The cover here taught thus allows a user to construct the cover from materials which enhance the visual appearance of the cover. In addition, the cover provides great flexibility in the choice of materials and thereby facilitates custom fabrication to better match the requirements of a particular installation. Furthermore, the cover provides a mold for shaping castable materials to better match the appearance of a surrounding fabricated surface constructed from castable material.

BRIEF DESCRIPTION OF THE DRAWINGS

An illustrative and presently preferred embodiment of the present invention is shown in the accompanying drawings in which.

DETAILED DESCRIPTION OF THE PREFERRED EMBODIMENT

Figure 1:
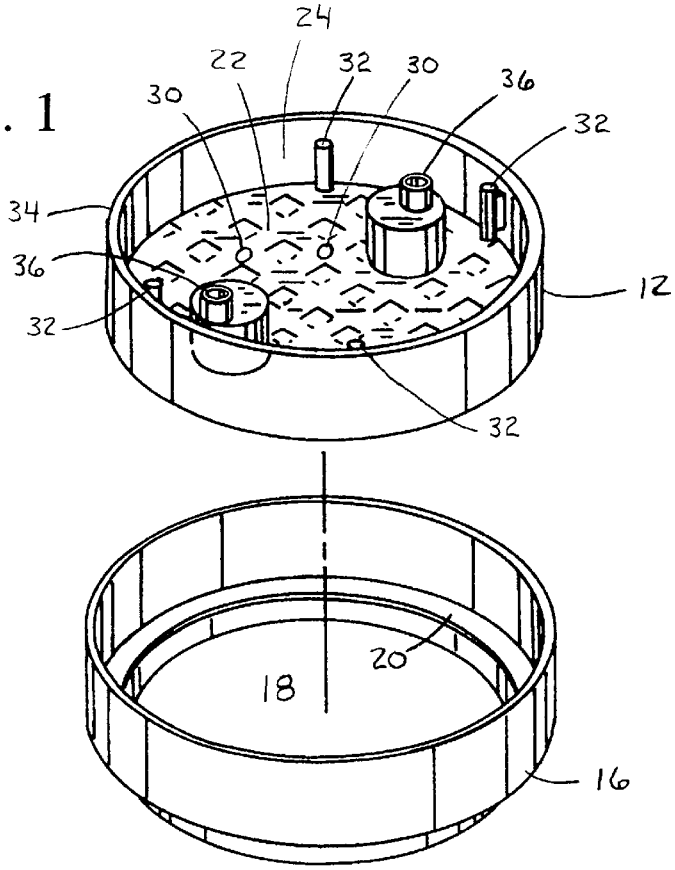
FIG. 1 is an exploded perspective view of a frame for constructing a utility opening in a fabricated surface and a cap member for constructing a cover for the opening.
Figure 2:
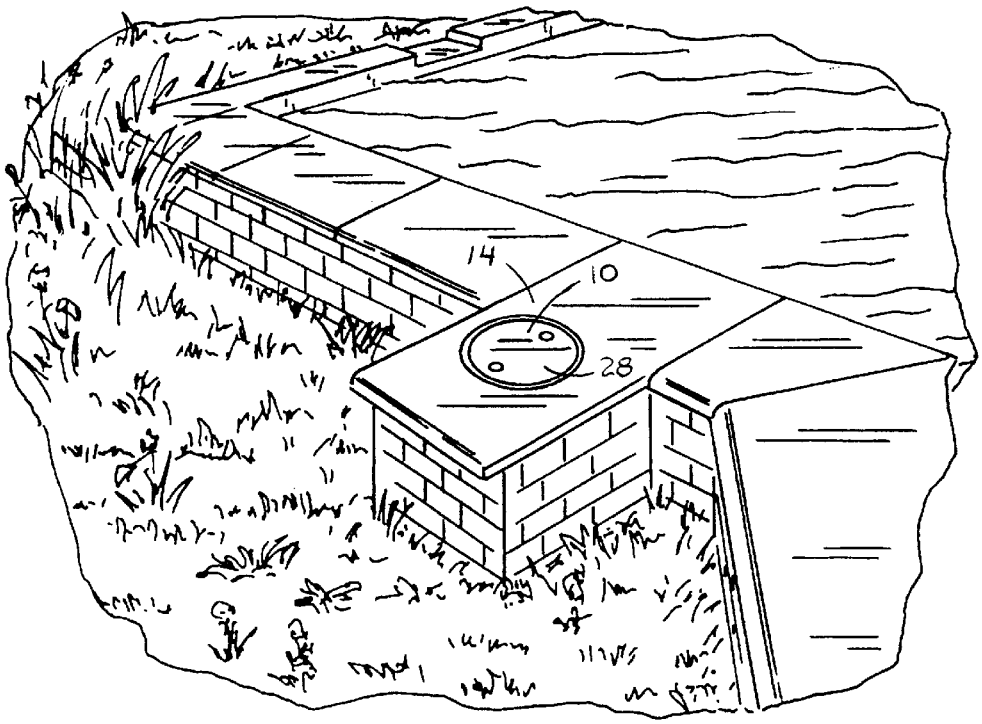
FIG. 2 is a perspective view of a fully constructed cover engaged with the frame of FIG. 1 positioned within a raised fabricated surface.

Referring to FIGS. 1 and 2, a cover 10 for closing a utility access opening is illustrated. The cover 10 includes a cap member 12 engageable within an access opening of a fabricated surface 14. The cover 10 is suitable for covering an access opening formed by the fabricated surface 14, however, the access opening is preferably formed with a frame 16 having an opening 18 disposed within the plane of the fabricated surface 14. To facilitate engagement of the cap member 12, the frame 16 can be provided with a rim 20 sized to engage the bottom plate 22 of the cap member 12. The cap member 12 and frame 16 can be constructed from any material having sufficient stiffness and durability, such as metal, fiberglass, plastic, ceramic, wood, etc.

Figure 5:
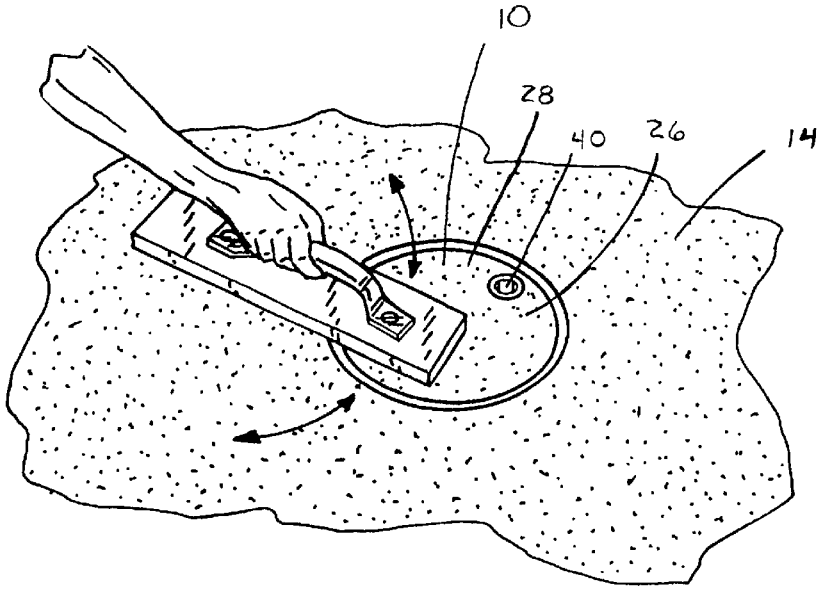
FIG. 5 is a perspective view of a cover and surrounding surface during construction of a ground level fabricated surface.

As particularly shown in FIGS. 1 and 5, the cap member has a substantially full cross sectional cavity 24 for receiving a selected material 26. The material 26 within the cavity 24 is selected to provide an exposed surface 28 having an appearance substantially identical with the exposed appearance of the fabricated surface 14. Additionally, when the selected material 26 is identical to the material of the fabricated surface 14, the exposed surface 28 and fabricated surface 14 will have compatible functional properties as well, such as respective coefficients of friction and coefficients of expansion. While a homogenous material 26 is shown in FIGS. 2 and 5–7, it is, of course, to be understood that non-homogenous materials such as stone and mortar or tile and grout can also be placed within the cavity 24 to provide an exposed surface 28 having a substantially identical appearance with a similarly non-homogenous fabricated surface. It is also to be understood, of course, that a person can select a material 26 to provide an exposed surface 28 with an appearance which is merely compatible with the appearance of the fabricated surface 14. For example, the user may prefer a material which completes a pattern in the overall landscape, or which creates a readily visible marker.

Referring again to FIG. 1, the cap member 12 can be provided with a plurality of drain holes 30 for draining moisture from the material 26 placed within the cavity 24, and a plurality of support posts 32 attached to the bottom plate 22 and lateral wall 34 of the cap member 12 for stiffening the lateral wall 34 and anchoring the material 26 within the cavity 24. Although two drain holes 30 and four support posts 32 are shown in FIG. 1, it is, of course, recognized that the cap member can be provided with one or more drain holes 30 or support posts 32. Referring to FIGS. 4–7, the cap member 12 can also be provided with hollow finger grip tubes 36 to form respective holes 40 extending through the material 26 and the bottom plate 22 when the material 26 is placed within the cavity 24. The tubes 36 preferably have a flared cross-section 38 and a resulting grip surface 42 to provide a finger hold for lifting the cap member 12 and material 26 from the access opening.

Figure 3:
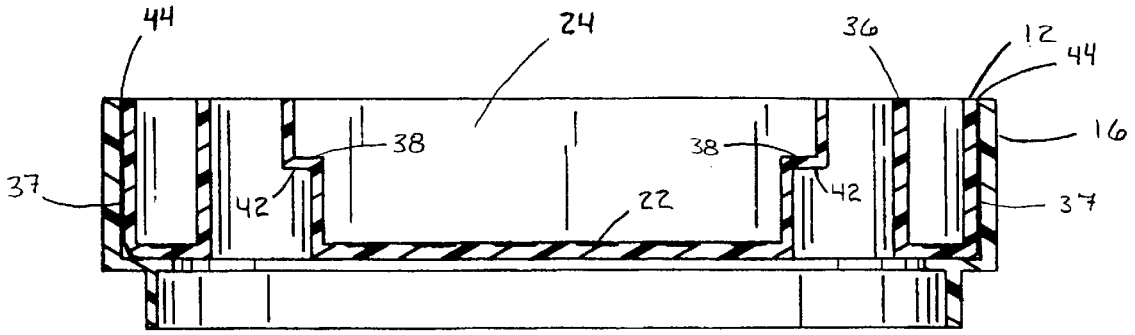
FIG. 3 is sectional side view of the cap member and frame of FIG. 1 engaged with each other and prior to placement of a selected material in the cavity of the cap member and prior to placement of the frame and cap member within the plane of a fabricated surface.

In use, the cap member 12 is placed within the frame 16 as shown in FIG. 3. Depending on the materials selected to construct the cover and fabricated surface, it may be advantageous to wrap a self-adhering tape 44 around the outer peripheral wall 37 of the cap member 12 prior to inserting the cap member 12 in the frame 16. When so applied, the self-adhering tape 44 prevents material from bonding to the cap member 12 and additionally minimizes the amount of excess material which may enter the gap between the frame 16 and cap member 12 as the cover and fabricated surface are constructed.

Figure 4:
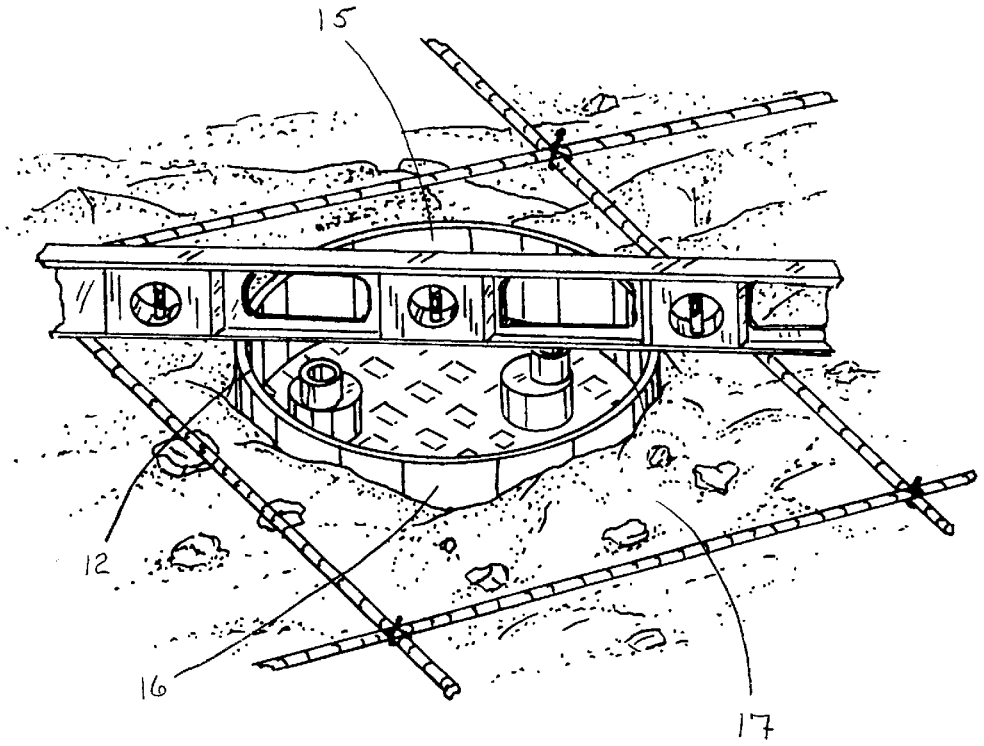
FIG. 4 is a perspective view of the cap member and frame of FIG. 1 being positioned for placement within a ground level structural surface.

Once the cap member 12 is engaged within the frame 16, the assembly 15 is placed within the intended plane for the fabricated surface as shown in FIG. 4. The assembly 15 is then positioned and leveled so the cap member 12 will ultimately seat in a substantially level and flush position with the fabricated surface. To obtain a level and flush position with the fabricated surface, it may be necessary to countersink the frame 16 into the base 17 upon which the fabricated surface will be constructed as described in FIG. 4. The correct orientation for the frame 16 and cap member 12 can also be verified with a level placed across the cap member 12.

After the assembly 15 is correctly positioned, the fabricated surface 14 is installed around the frame 16, and a material 26 is placed within the cavity 24 of the cap member 12. As shown in FIG. 5, the exposed surface 28 of the material 26 typically must be smoothed and leveled so the cover 10 will seat in a level and flush position with the surrounding fabricated surface 14.

Figure 6:
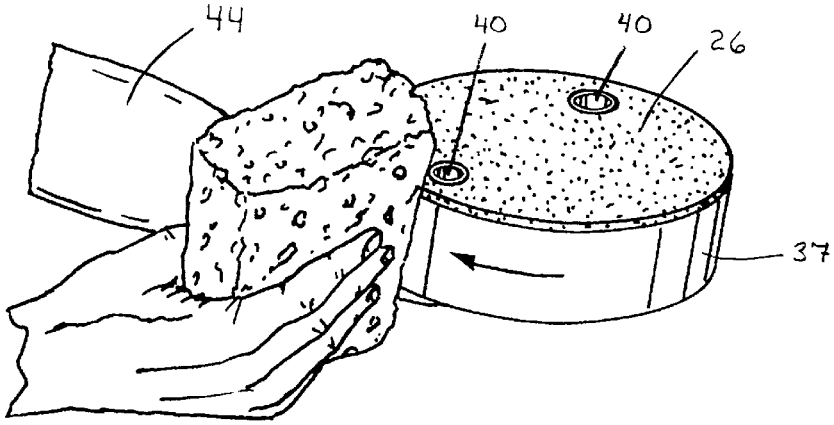
FIG. 6 is a perspective view of the cover of FIG. 5 showing a second step in the assembly of the cover.
Figure 7:
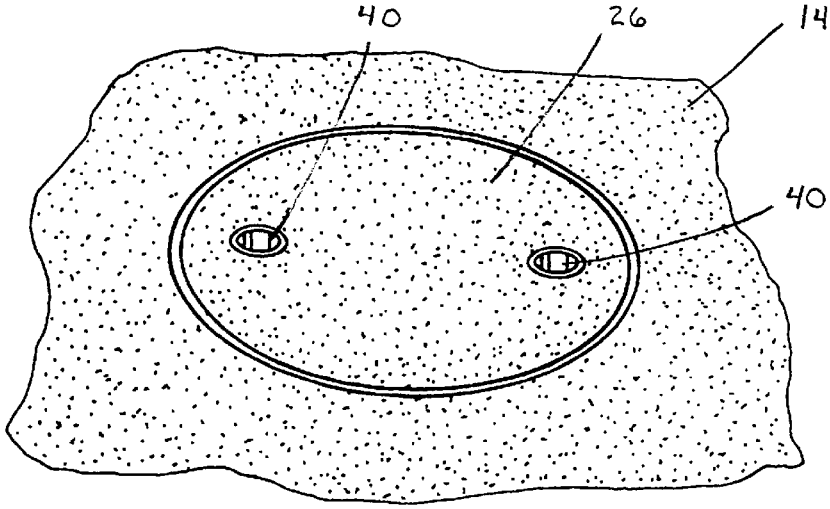
FIG. 7 is a perspective view of the cover and surrounding surface of FIG. 5 upon completion.

Once the material 26 has sufficiently stabilized within the cavity 24, the cover 10 is removed from the frame 16, the tape 44 (if applied) is removed from the cap member 12, and any excess material is cleaned from the frame 16 and the cap member 12 as shown in FIG. 6. The time required for stabilization will depend on the selected material 26, however, persons skilled in the art will recognize that the cover 10 typically should not be removed from the frame 16 until it is certain that the material 26 will remain in the cavity 24 of the cap member 12 and that the exposed surface 28 remain smoothed and level. The cover 10 is then reinserted within the frame 16 for final placement until access is required as shown in FIG. 7.

In this manner, access is provided for critical utilities disposed underneath the cover 10. In addition, the cover 10 can be constructed from a material 26 which provides an exposed surface 28 having an appearance substantially identical with the fabricated surface 14. Moreover, the functional properties of the exposed surface 28 will also be compatible with those of the fabricated surface 14 if the cover 10 is constructed from the same material as the fabricated surface 14. Furthermore, the cover 10 is custom fabricated to better match with the great variety of different fabricated surfaces. Thus, while it is recognized that an illustrative and presently preferred embodiment of the invention has been described in detail herein, it is likewise to be understood that the inventive concepts may be otherwise embodied and employed and that the appended claims are intended to be construed to include such variations except insofar as limited by the prior art.

What is claimed is:

1. A cover for closing a utility access opening, said access opening extending through a fabricated surface having an exposed appearance, the cover comprising a cap member engageable within the opening, said cap member having a cross sectional cavity adapted to receive a selected material, said cap member further having at least one hand engageable grip for lifting the cap member and the material placed in the cavity of the cap member from the opening, wherein said cap member with said material disposed within the cavity thereof provides an exposed surface having an appearance substantially identical to the exposed appearance of the fabricated surface.

2. The cover as claimed in claim 1 wherein the selected material is castable.

3. The cover as claimed in claim 1 wherein the cap member additionally has at least one hole for draining moisture from the material placed within the cavity of the cap member.

4. The cover as claimed in claim 1 having two hand engageable grips which are a pair of hollow tubes for creating respective holes extending through the cap member and the materials placed in the cavity of the cap member, said tubes sized for receiving human fingers and having a flared cross section for gripping the tube with human fingers.

5. The cover as claimed in claim 1 wherein the cap member has a bottom plate, a lateral wall, and a plurality of support posts disposed within the cavity of the cap member wherein each post is attached to both the bottom plate and the lateral wall.

6. An access assembly for constructing a covered access opening, said access opening extending through a fabricated surface having an exposed appearance, the assembly comprising:

a) a frame having an opening for lining a wall surface of an access passage through the fabricated surface; and b) a cap member engageable within the opening of the frame, said cap member having a cross sectional cavity adapted to receive a selected material, said cap member further having at least one hand engageable grip for lifting the cap member and the material placed in the cavity of the cap member from the opening.

7. The assembly as claimed in claim 6 wherein the selected material is castable.

8. The assembly as claimed in claim 6 wherein the cap member additionally has at least one hole for draining moisture from the material placed within the cavity of the cap member.

9. The assembly as claimed in claim 6 having two hand engageable grips which are a pair of hollow tubes for creating respective holes extending through the cap member and the materials placed in the cavity of the cap member, said tubes sized for receiving human fingers and having a flared cross section for gripping the tube with human fingers.

10. The assembly as claimed in claim 6 wherein the cap member has a bottom plate, a lateral wall, and a plurality of support posts disposed within the cavity of the cap member wherein each post is attached to both the bottom plate and the lateral wall.

11. The assembly as claimed in claim 6 additionally comprising a selected material within said cavity and wherein said selected material has an appearance substantially identical to said exposed appearance of the fabricated surface.

12. The assembly as claimed in claim 6 additionally comprising a selected material within said cavity and wherein said selected material has an appearance compatible with said exposed appearance of the fabricated surface.

13. The assembly as claimed in claim 6 wherein the frame has an interior rim for engaging the cap member.

14. A method of constructing a fabricated surface with a closable opening therethrough, the method comprising the steps of:

(a) providing a frame having an opening;

(b) providing a cap member engageable within the opening of the frame, said cap member having an outer peripheral wall and a cross sectional cavity adapted to receive a selected material, said cap member further having at least one hand engageable grip for lifting the cap member and the material placed in the cavity of the cap member from the opening;

(c) engaging the cap member within the opening of the frame and placing the frame and cap member assembly within an intended plane for a fabricated surface;

(d) positioning the frame and cap member assembly such that the fabricated surface is constructable around the frame and cap member with the cap member in a substantially level and flush position with the fabricated surface;

(e) constructing the fabricated surface around the frame;

(f) inserting a selected material within the cavity of the cap member, said selected material being substantially identical in appearance to the fabricated surface; and (g) leveling the selected material placed within the cavity of the cap member such that the material will be disposed in a substantially level and flush position with the fabricated surface.

15. The method of claim 14 wherein the cap member additionally has at least one hole for draining moisture from the material placed within the cavity of the cap member.

16. The method of claim 14 having two hand engageable grips which are a pair of hollow tubes for creating respective holes extending through the cap member and the materials placed in the cavity of the cap member, said tubes sized for receiving human fingers and having a flared cross section for gripping the tube with human fingers.

17. The method of claim 14 wherein the cap member has a bottom plate, a lateral wall, and a plurality of support posts disposed within the cavity wherein each post is attached to both the bottom plate and the lateral wall.

18. The method of claim 14 wherein the frame has an interior rim for engaging the cap member.

19. A cover for closing a utility access opening, said access opening extending through a fabricated surface having an exposed appearance, the cover comprising a cap member engageable within the opening, said cap member having a cross sectional cavity adapted to receive a selected material, said cap member further having a bottom plate, a lateral wall, and a plurality of support posts disposed within the cavity of the cap member wherein each post is attached to both the bottom plate and the lateral wall, wherein said cap member with said material disposed within the cavity thereof provides an exposed surface having an appearance substantially identical to the exposed appearance of the fabricated surface.

20. An access assembly for constructing a covered access opening, said access opening extending through a fabricated surface having an exposed appearance, the assembly comprising:

a) a frame having an opening for lining a wall surface of an access passage through the fabricated surface; and b) a cap member engageable within the opening of the frame, said cap member having a cross sectional cavity adapted to receive a selected material, said cap member further having a bottom plate, a lateral wall, and a plurality of support posts disposed within the cavity of the cap member wherein each post is attached to both the bottom plate and the lateral wall.

21. A method of constructing a fabricated surface with a closable opening therethrough, the method comprising the steps of:

(a) providing a frame having an opening;

(b) providing a cap member engageable within the opening of the frame, said cap member having an outer peripheral wall and a cross sectional cavity adapted to receive a selected material, said cap member further having a bottom plate, a lateral wall, and a plurality of support posts disposed within the cavity of the cap member wherein each post is attached to both the bottom plate and the lateral wall;

(c) engaging the cap member within the opening of the frame and placing the frame and cap member assembly within an intended plane for a fabricated surface;

(d) positioning the frame and cap member assembly such that the fabricated surface is constructable around the frame and cap member with the cap member in a substantially level and flush position with the fabricated surface;

(e) constructing the fabricated surface around the frame;

(f) inserting a selected material within the cavity of the cap member, said selected material being substantially identical in appearance to the fabricated surface; and (g) leveling the selected material placed within the cavity of the cap member such that the material will be disposed in a substantially level and flush position with the fabricated surface.

* * * * *